US006142302A

United States Patent [19]

Requena

[11] Patent Number: 6,142,302

[45] Date of Patent: Nov. 7, 2000

[54] SELF-OPENING BAG STACK AND METHOD OF PRODUCING SAME

[75] Inventor: Eduardo A. Requena, Houston, Tex.

[73] Assignee: Better Bags, Inc., Houston, Tex.

[21] Appl. No.: 09/393,414

[22] Filed: Sep. 10, 1999

[51] Int. Cl.[7] ..... B65D 1/34

[52] U.S. Cl. ..... 206/554; 383/13; 493/194

[58] Field of Search ..... 206/494, 554; 383/13, 22, 24; 493/194, 195, 203, 204

[56] References Cited

U.S. PATENT DOCUMENTS

| | | | |
|---|---|---|---|
| Re. 33,264 | 7/1990 | Baxley et al. | 206/554 |
| 3,318,444 | 5/1967 | Weicher et al. | 206/554 |
| 3,341,003 | 9/1967 | Marsh | 206/554 |
| 3,771,645 | 11/1973 | Wendel | 206/554 |
| 4,406,371 | 9/1983 | Membrino | 206/554 |
| 4,527,693 | 7/1985 | Membrino | 206/554 |
| 4,557,384 | 12/1985 | Membrino | 206/554 |
| 5,335,788 | 8/1994 | Beasley et al. | 206/554 |
| 5,575,393 | 11/1996 | Gebhardt | 206/554 |
| 5,655,682 | 8/1997 | Hoffrichter | 206/554 |
| 5,732,833 | 3/1998 | Alvarado et al. | 206/554 |
| 5,788,080 | 8/1998 | Sill et al. | 206/554 |
| 5,941,393 | 8/1999 | Wilfong, Jr. | 206/554 |

*Primary Examiner*—Jim Foster

*Attorney, Agent, or Firm*—Tobor, Goldstein & Healey, L.L.P.; Clarence F. Eriksen

[57] ABSTRACT

A bag stack made of low density polyethylene material is disclosed. The bag stack comprises a plurality of bags where consecutive bags are adhesively connected together and where the back walls of the bags in the stack are hot welded together near the tops of the back walls of the bags. When a bag is removed from the stack, the front wall of the following bag is pulled open to permit easy removal of the next bag. A method is disclosed for forming a bag stack in accordance with the present invention.

10 Claims, 3 Drawing Sheets

SELF-OPENING BAG STACK AND METHOD OF PRODUCING SAME

BACKGROUND OF THE INVENTION

1. Field of the Invention

The present invention relates generally to self-opening, side-sealed bags made of a linear low density polyethylene material.

2. Description of the Prior Art

Plastic bags for customer use and convenience are widely used in many types of retail stores and commonly provided in grocery stores and supermarkets. Plastic bags of the type to which the present invention is directed are often provided as a means to hold produce items, e.g., fruits and vegetables, and may also be used to hold poultry, meat, seafood and bakery products. Such bags also provide a means of segregating from one another the various items to be purchased by the customer, which facilitates the checkout process.

Prior art plastic bags have sometimes been manufactured in a continuous roll with a perforation between the adjacent bags. A bag is removed from such a roll by exerting force to tear a bag from the roll along the perforation. Once the bag has been removed, the customer is faced with the sometimes difficult task of opening the bag.

It is also known in the art to manufacture and assemble plastic bags into a bag stack which are then dispensed from an appropriate assembly. Such a stack of plastic bags includes a disposable upper portion which is detachably connected to the lower portion containing the plastic bags by making perforations between the upper portion and the bags. A header is attached to or built into the upper portion to permit the stack to hang on a dispensing assembly. When a customer desires to use a plastic bag, the customer pulls on the outermost plastic bag in the stack and tears it away from the upper disposable portion at the perforation. The customer may also encounter difficulty in opening such bags.

A common type of bag which has found significant use at checkout counters in grocery stores and supermarkets has been the so-called T-shirt bag, which provides laterally spaced handles that extend upwardly from opposed sides of an open mouth in the top of the bag to provide ease in carrying of the bag by the customer. These bags may also be fabricated in stacks, and usually the stacks of these bags have holes formed in the handles for attachment to a dispensing apparatus. These T-shirt plastic bags have typically been fabricated from high density polyethylene (HDPE), which has different manufacturing and processing characteristics from the lower density polyethylene.

SUMMARY OF THE INVENTION

In accordance with the present invention, a method of manufacturing a stack of self-opening, side-sealed bags of a low density polyethylene material is provided. Each of the bags produced by the method of the present invention has front and rear walls of a predetermined width, and the height of the front wall of each bag is less than the height of the back wall of each bag.

The method according to the present invention comprises moving flattened tube material made of low density polyethylene material through a bag making machine, with the side of the flattened tube material which will form the front wall of each bag facing upward. Dots of glue are deposited on the upward facing side of the flattened tube material as it moves through the bag making machine. The spacing between sequential dots of glue is substantially equal to the predetermined width of the bag, and each dot of glue is deposited below the top of the front wall of the bag. The temperature of each dot of glue is reduced as the glue is deposited on the tube material so that the glue does not melt the polyethylene film.

A length is then cut from the polyethylene roll which is equal to the predetermined width of the bag and the sides of the bag are sealed. The dot of glue on the front of each bag is substantially equidistant from the two sides of the bag once the cutting and sealing process is complete.

The method of the present invention then comprises stacking a predetermined number of bags on top of and in registration with each other. Once the bag stack contains a suitable number of bags, all bags in the stack are perforated by passing a serration tool through the stack. The perforations define the top of the back wall of each bag.

In accordance with the present invention, the back walls of the bags in the stack are then hot welded together by passing two hot needles through the back walls in the space or gap between the tops of the front walls and the tops of the back wall. The needles are positioned so that the holes made by them in the stack are on opposite sides of and spaced from the centerline of the stack of bags. Preferably, the holes are equally spaced from the centerline of the stack of bags.

In accordance with the present invention, a bag stack is provided which comprises a bag assembly including a plurality of side-sealed bags which are made from a low density polyethylene material. Each of the side-sealed bags in the stack has a front wall and a rear wall, and the length of the back wall of each bag is greater than the length of the front wall. The bag assembly further includes a disposable upper portion made of low density polyethylene material to which the bags are releasably attached in substantial registration with one another.

A bag stack in accordance with the present invention also comprises an adhesive material which is deposited between the back wall of each bag in the stack and the front wall of the following bag in the stack. Additionally, a bag stack in accordance with the present invention comprises two hot weld areas which extend through the back walls of the bags in the stack. The two hot weld areas are located on opposite sides of and spaced from the centerline of a bag and are formed in the space or gap between the tops of the back walls and tops of the front walls of the bags in the stack.

A bag stack in accordance with the present invention further comprises a header which may be attached to or built into the upper disposable portion for hanging the bag stack.

DESCRIPTION OF SPECIFIC EMBODIMENTS

It will be appreciated that the present invention can take many forms and embodiments. Some embodiments of the invention are described so as to give an understanding of the invention. These embodiments are intended to illustrate and not to limit the present invention.

Figure 2:
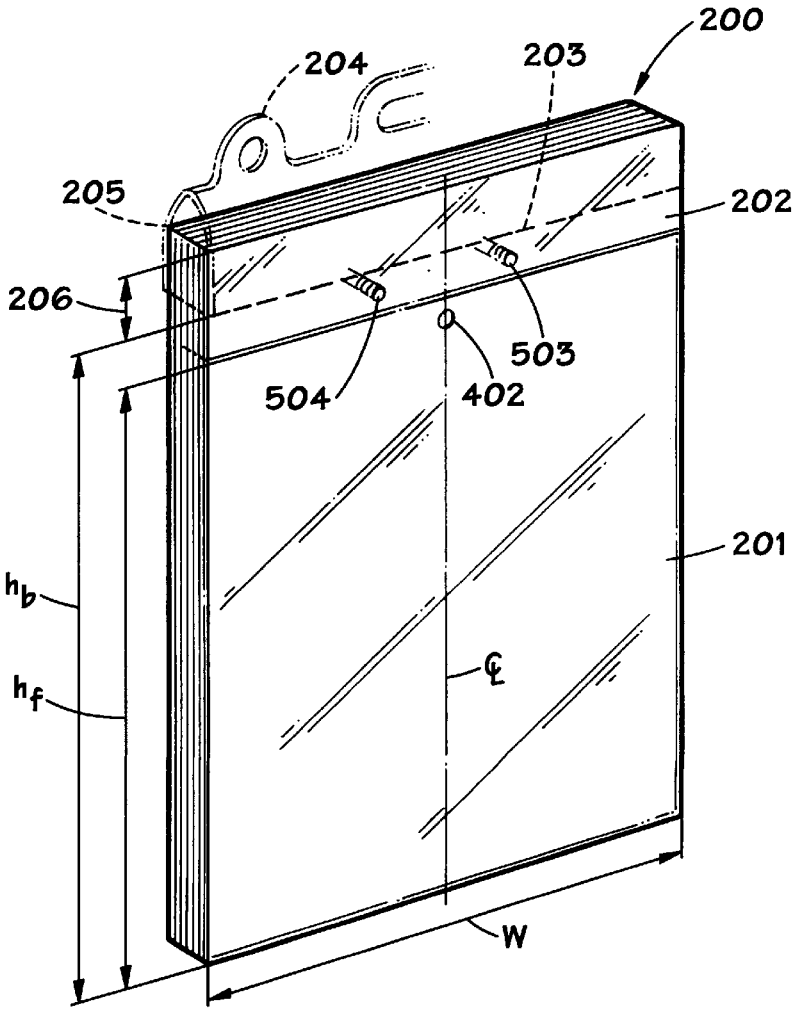
FIG. 2 is a perspective view of a bag stack that has been formed in accordance with the present invention.

With reference first to FIG. 2, a bag stack 200 in accordance with the present invention comprises a plurality of side-sealed bags having a front wall 201 and back wall 202. The height $h_b$ of the back wall 202 is greater than the height $h_f$ of the front wall 201, and hb is preferably ¾" longer than $h_f$. The bags in the stack 200 have a predetermined width W. As used in this specification and in the appended claims, the "centerline" of a bag is an imaginary line which is equidistant from the sides of the bag.

As known in the bag making art, tubular film is extruded in an inflated condition and is then collapsed and wound up in a flattened condition. Between the time of flattening of the film and the time that it is wound up, the film is subjected to a corona treatment on one side of the flattened film. Corona treatment processes are well known in the art and are conventionally employed with all of the various grades of polyethylene films in order to provide an ink receptive surface. Following the corona treatment, well known printing techniques may be utilized to print information on the flattened film material, if such printing is desired.

It is also known in the bag making art that many types of machines exist for making bags, including a single wicketer machine and a twin wicketer bag making machine. A single wicketer machine makes one bag at a time, while a twin wicketer machine makes two bags at a time. Preferably, the method of the present invention is implemented using a twin wicketer machine. Those skilled in the art will recognize that the method of the present invention may also be used in conjunction with other types of bag making machines.

Figure 1:
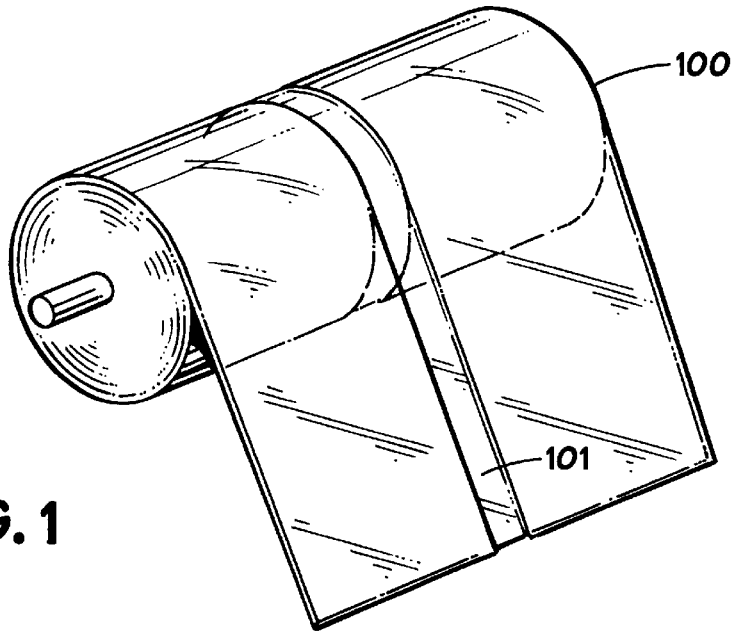
FIG. 1 is a perspective view of a roll of flattened low density polyethylene tube material that is used in the process of the present invention to make two bags simultaneously.

With reference now to FIG. 1, there is depicted a roll 100 of low density polyethylene film that is being wound up in a flattened condition. Any low density polyethylene may be used to fabricate the film on roll 100; however, the film on roll 100 is preferably fabricated using linear low density polyethylene pellets sold by Nova under the trade designation TF-Y826D (Hexene base). Since a twin wicketer machine is preferably used to make bag stacks in accordance with the method of the present invention, a central portion of film on one side of the flattened material, e.g., the top layer, has been removed, resulting in the formation of gap 101. Gap 101 is preferably three and one-half inches in width and is removed from the flattened tubular material prior to the printing of information on the bag material.

Figure 3:
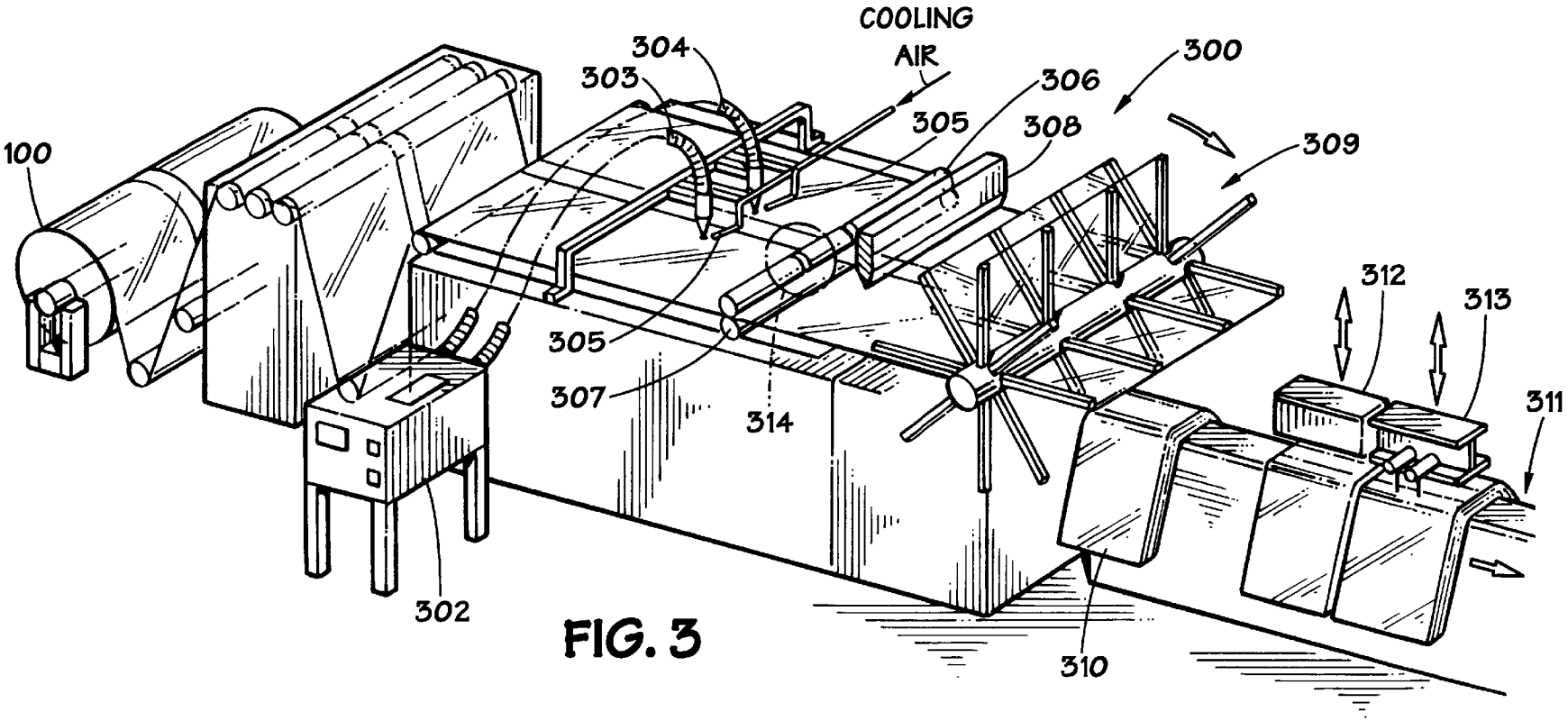
FIG. 3 is a perspective view of a bag making machine that is used in the process of the present invention.

With reference to FIG. 3, after the printing of information is completed, the roll of film 100 is attached to a bag making machine 300. Preferably, the bag making machine 300 is an FMC model 1106TW, which is available from FMC Corporation. In accordance with the present invention, the flattened low density polyethylene film on roll 100 is moved through the bag making machine 300 in the direction 301, with the side of the film corresponding to the front of the bag being upward. This side corresponds to the side of the polyethylene film with the gap 101 as shown in FIG. 1. As the polyethylene film is moved through the bag making machine, drops of glue are deposited on the polyethylene material near the top of the front wall of each bag. These drops are glue are deposited using gluing machine 302 which is preferably a model 4400 glue machine which is available from Valco. The glue which is used in the glue machine 302 is preferably one with a low tackiness such as a glue which is commonly known as "credit card" glue. A particularly suitable glue is the glue sold by Capital Adhesives & Packaging Corporation under the designation HM150.

The glue machine 302 dispenses dots of glue onto the film passing through the bag making machine via glue dispensing hoses 303 and 304. Each glue dispensing hose 303, 304 has a tip proximate the polyethylene film, and the glue machine 302 is programmed such that the temperature of the glue at the tip of the glue dispensing hoses 303 and 304 is in the range 289° F.–296° F.

Since glue in the aforesaid temperature range may tend to melt the polyethylene film which is moving through the machine, the method of the present invention also includes reducing the temperature of the glue as it is deposited on the polyethylene film. This is advantageously accomplished by use of cool air apparatus 305 which sprays cool dry air across the dots of glue as they are deposited.

In accordance with the present invention, sequential dots of glue are applied to the polyethylene film at an interval which corresponds to the width that each of the polyethylene bags is to have. Each drop of glue is deposited at a point just below the top of what will become the front wall of each bag, and preferably the distance between the dot of glue and what will become the top of the front wall of each bag is ¼".

Figure 4:
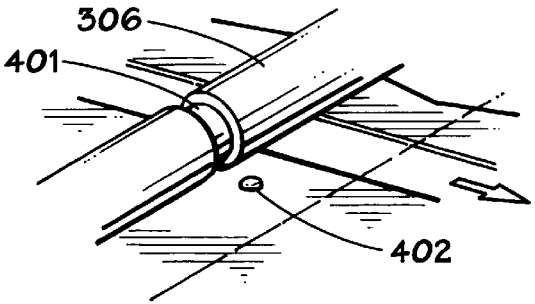
FIG. 4 is an enlarged perspective view of the portion of the upper draw roller in FIG. 3 which is designated by the numeral 314 in FIG. 3.

The bag making machine 300 has upper and lower draw rollers 306 and 307 which move the polyethylene film through the bag making machine. As illustrated in FIG. 4, a portion 401 of the upper drawer 306 has been removed so that each dot of glue 402 may pass through the draw rollers without interference.

Referring again to FIG. 3, after the polyethylene film passes through the draw roller, cutting and sealing blade 308 cuts the polyethylene film to the predetermined width W of a bag. Cutting and sealing blade 308 also seals the upstream sides of the bags, the downstream sides of the bags having been sealed in the previous cutting/sealing operation with respect to the previous bag. Vacuum arms 309 take the cut bags and stack them on top of and in substantial registration with one another to form stack 310.

Once a suitable number of bags, e.g., 250, have been stacked, the conveyor portion 311 moves the stack under the serration device 312, which forms the perforations 203 (FIG. 2) in the stack of bags. These perforations define the top of the back wall of each bag in the stack.

Figure 5:
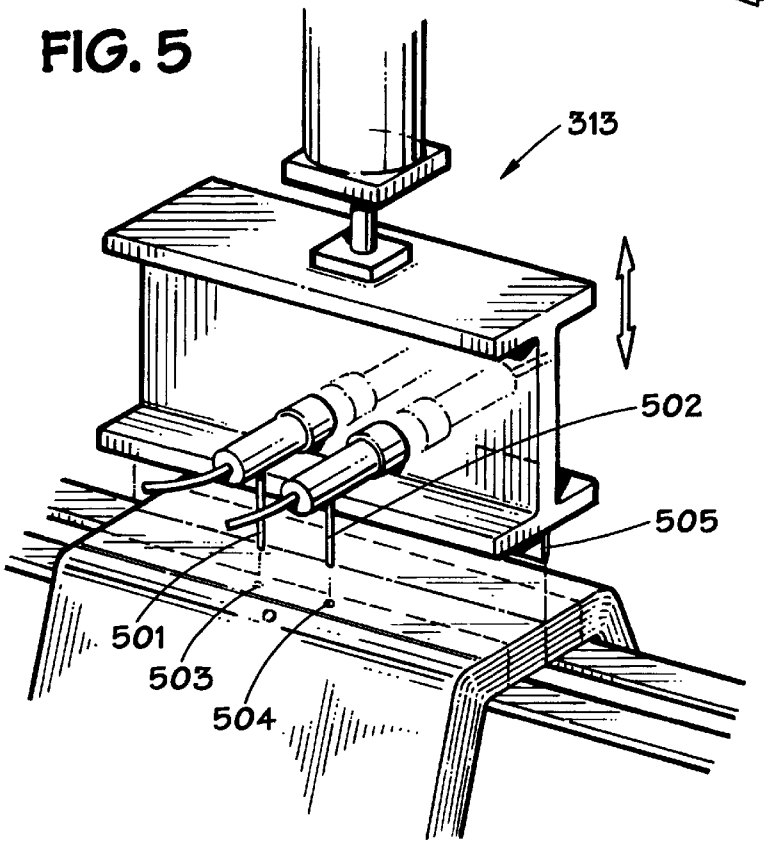
FIG. 5 is a perspective view of the cutting and hot welding apparatus 313 in FIG. 3.

With reference to both FIGS. 3 and 5, after the next stack of bags has been formed (as described above), the conveyor apparatus 311 moves the perforated stack under cutting and hot welding apparatus 313. This apparatus comprises two hot needles 501 and 502, and the temperature of these needles is preferably 420° F. Needles 501 and 502 are preferably ⅛" in diameter and are passed through the back walls of the bags in the stack to make two hot welded areas 503 and 504. The hot welded areas are formed on opposite sides of the centerline of the bags and are spaced from the centerline. Preferably, each hot welded area 503, 504 is spaced one inch from the centerline of the bags. The hot welded areas 503 and 504 are formed in the space or gap between the tops of the front walls and the tops of the back walls of the bags. Preferably, each hot welded area 503, 504 is formed ½" below the tops of the back walls of the bags in the stack. (i.e., ½" below the perforations). Cutting and hot welding apparatus 313 also includes blade 505 which is used to separate the two stacks of bags and to hot weld the top of the upper assembly 205 (FIG. 2). Following separation, a header 204 (FIG. 2) may be installed on the upper assembly 205 of each stack of bags. The height 206 of upper assembly 205 is preferably 1".

Figure 6:
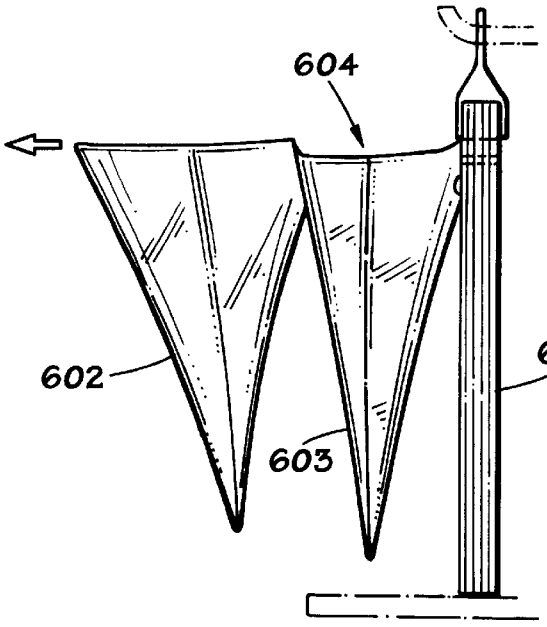
FIGS. 6 and 7 are side views of a bag stack in accordance with the present invention.
Figure 7:
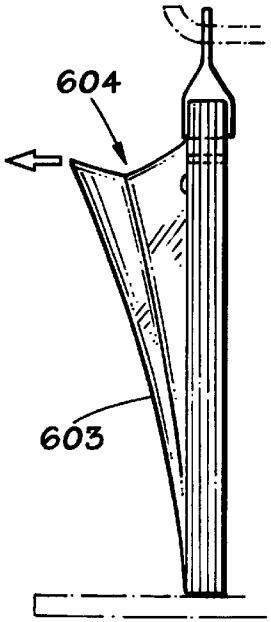

With reference to FIGS. 6 and 7, a bag is removed from the bag stack 601 of the present invention by pulling on the front wall of outermost bag 602 in the stack. As bag 602 is pulled, the mouth 604 of the following bag 603 is opened as a result of the adhesive between the back wall of bag 602 and the front wall of bag 603. When sufficient force is applied to bag 602, the back wall of bag 602 separates from the adhesive. However, the force necessary to cause this separation is less than the counterforce exerted on the stack from the two hot weld areas 503 and 504. Accordingly, the back wall of bag 603 remains in place, once bag 602 has been removed from the stack. The mouth of bag 603 has been substantially opened by the removal of bag 602, which facilitates the removal of bag 603 from the stack, when desired.

What is claimed is:

1. A method of making a stack of self-opening, side-sealed bags of low density polyethylene, where each of said bags has front and rear walls of a predetermined width and where the height of the front wall of each bag is less than the height of the back wall of each bag, comprising:

(a) moving flattened low density polyethylene tube material through a bag making machine with the side of the flattened tube material which will form the front wall of each bag facing upward;

(b) depositing dots of glue on the upward-facing side of the flattened tube material as it moves through the bag making machine, the spacing between sequential dots being equal to the predetermined width of the bag and the location of each dot being below the top of the front wall of the bag;

(c) reducing the temperature of each dot of glue as it is deposited;

(d) cutting the polyethylene roll to the predetermined width for the bag and sealing the sides of the bag so that the dot of glue on the back of each bag is substantially equidistant from the two sides of the bag;

(e) stacking a predetermined number of bags on top of and in registration with each other;

(f) simultaneously perforating all bags in a stack by passing a serration tool through the stack, the perforations defining the top of the back wall of each bag; and (g) hot welding the back walls of the bags in a stack together by passing two hot needles through the back walls in the space between the tops of the back and front walls, the holes in the stack formed by the needles being spaced from and on opposite sides of the centerline of the stack of bags.

2. The method of claim 1, wherein it further comprises attaching a header to each stack of bags.

3. The method of claim 1, wherein the temperature of the needles is approximately 420° F.

4. The method of claim 1, wherein the length of the back wall of the bag is approximately ¾" longer than the length of the front wall of the bag and wherein the dot of glue is deposited at a location approximately ¼" below the top of the front wall of the bag.

5. The method of claim 1, wherein the needles are approximately one-eighth (⅛") inch in diameter.

6. The method of claim 1, wherein each hot needle is located approximately one inch (1") from the centerline of the bag and wherein the hot needles are inserted into the stack approximately one-half inch below the perforations.

7. A bag stack comprising:

a bag assembly comprising: (i) a plurality of side-sealed bags having front and back walls where the height of the rear wall of each bag is greater than the height of the front wall which bags are fabricated from low density polyethylene material; and (ii) an upper disposable portion made of low density polyethylene to which the bags are releasably attached in substantial registration with one another;

adhesive material which is disposed between the back wall of each bag in the stack and the front wall of the following bag in the stack;

two hot weld areas which extend through the back walls of the bag stack, said hot weld areas being located on opposite sides of and spaced from the centerline of a bag and said hot weld areas being formed in the space between the tops of the back walls and the tops of the front walls of the bags in the stack; and a header which is attached to the disposable upper portion for hanging the bag stack.

8. The bag stack of claim 7, wherein the adhesive material is applied proximate to the top of the front wall of each bag.

9. The bag stack of claim 8, wherein the adhesive material is applied approximately one-quarter inch below the top of the front wall of each bag.

10. The bag stack of claim 7, wherein the hot weld areas which extend through the bag stack are substantially circular in shape.

* * * * *